US010112091B2

(12) United States Patent
Long et al.

(10) Patent No.: US 10,112,091 B2
(45) **Date of Patent: *Oct. 30, 2018**

(54) REMOVABLE, ROTATABLE GRIP ELEMENT FOR A BALL BAT OR OTHER SPORTING-GOOD IMPLEMENT

(71) Applicant: EASTON DIAMOND SPORTS, LLC, Thousand Oaks, CA (US)

(72) Inventors: Keenan Long, Sherman Oaks, CA (US); Ian Montgomery, Simi Valley, CA (US)

(73) Assignee: EASTON DIAMOND SPORTS, LLC, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/282,989

(22) Filed: Sep. 30, 2016

(65) Prior Publication Data

US 2017/0014697 A1 Jan. 19, 2017

Related U.S. Application Data

(63) Continuation of application No. 14/313,186, filed on Jun. 24, 2014, now Pat. No. 9,457,248.

(51) Int. Cl.
*A63B 60/06* (2015.01)
*A63B 60/14* (2015.01)
(Continued)

(52) U.S. Cl.
CPC ..... *A63B 60/14* (2015.10); *A41D 19/0024* (2013.01); *A63B 59/50* (2015.10); *A63B 60/06* (2015.10); *A63B 71/141* (2013.01); *A41D 2400/80* (2013.01); *A41D 2600/10* (2013.01); *A63B 60/10* (2015.10); *A63B 60/30* (2015.10);
(Continued)

(58) Field of Classification Search
CPC . A63B 59/0014; A63B 59/06; A63B 59/0029; A63B 59/0025; A63B 2069/008
USPC ..... 473/457, 568, 201–206, 300–303; 2/161.1, 161.2, 161.3
See application file for complete search history.

(56) References Cited

U.S. PATENT DOCUMENTS 1,305,952 A 6/1919 Suesman et al.
1,690,312 A 11/1928 Rosan
(Continued)

FOREIGN PATENT DOCUMENTS

| | | | |
|---|---|---|---|
| CN | 102274616 | A | 12/2011 |
| JP | 2004097428 | A | 4/2004 |
| JP | 4870310 | B2 | 2/2012 |
| WO | 1993017855 | | 9/1993 |
| WO | 1995019821 | | 7/1995 |

OTHER PUBLICATIONS

USPTO, Notice of Allowance for U.S. Appl. No. 14/975,261, dated Jul. 28, 2017 (11 pages).
(Continued)

*Primary Examiner* — Mark Graham
(74) *Attorney, Agent, or Firm* — Perkins Coie LLP

(57) ABSTRACT

A sleeve or grip for use on a ball bat or other sporting-good implement includes a low-friction inner surface and a longitudinal slit that facilitates its positioning on, and removal from, a handle of the implement. The grip is rotatable about the handle so that a user's hand may move into an optimal position during a swing. The grip may be readily removable from the implement so that, after a swing, it stays with the user, as opposed to remaining on the implement.

5 Claims, 3 Drawing Sheets

(51) Int. Cl.

| | |
|---|---|
| ***A63B 59/50*** | (2015.01) |
| ***A63B 71/14*** | (2006.01) |
| ***A41D 19/00*** | (2006.01) |
| *A63B 60/10* | (2015.01) |
| *A63B 60/30* | (2015.01) |
| *A63B 102/18* | (2015.01) |

(52) U.S. Cl.
CPC ..... *A63B 2102/18* (2015.10); *A63B 2102/182* (2015.10); *A63B 2209/10* (2013.01)

(56) References Cited

U.S. PATENT DOCUMENTS 2,084,428 A 6/1937 Bush
2,225,839 A 12/1940 Moore
2,242,318 A 5/1941 Mosier et al.
2,471,610 A 5/1949 Christensen et al.
2,659,605 A 11/1953 Letourneau
3,624,881 A 12/1971 Brown et al.
3,804,413 A 4/1974 Hrivnak et al.
3,805,413 A 4/1974 Burny et al.
3,834,714 A 9/1974 Smolinski et al.
4,461,043 A 7/1984 Lomedico et al.
4,561,122 A 12/1985 Stanley et al.
4,571,960 A 2/1986 Hursh et al.
4,691,387 A 9/1987 Lopez
4,754,499 A 7/1988 Pirie et al.
4,815,147 A 3/1989 Gazzano et al.
4,881,276 A 11/1989 Swan et al.
4,892,315 A 1/1990 Iorlano
5,011,145 A 4/1991 Bartkowicz
5,035,428 A 7/1991 Bartkowicz
5,069,454 A * 12/1991 Frost ..... A63B 60/10 2/20
5,081,715 A 1/1992 Mascia
5,180,165 A 1/1993 Frost
5,218,719 A 6/1993 Johnson et al.
5,238,246 A 8/1993 Erb et al.
5,257,418 A 11/1993 Jaskiewicz
5,259,610 A 11/1993 Erb et al.
5,322,286 A 6/1994 Frost
5,342,046 A 8/1994 Erb et al.
5,467,484 A 11/1995 Drescher et al.
5,482,270 A 1/1996 Smith
5,500,956 A 3/1996 Schulkin et al.
5,557,803 A 9/1996 Granich et al.
5,577,722 A 11/1996 Glassberg
5,588,651 A 12/1996 Frost
5,590,420 A 1/1997 Gunn
5,593,158 A 1/1997 Filice et al.
5,611,533 A 3/1997 Williams et al.
5,624,114 A 4/1997 Kelsey
5,640,712 A 6/1997 Hansen et al.
5,704,845 A 1/1998 Boyte et al.
5,758,365 A 6/1998 Steeley
5,790,980 A 8/1998 Yewer et al.
5,806,091 A 9/1998 McHugh et al.
5,815,838 A 10/1998 Lord et al.
5,839,983 A 11/1998 Kramer
5,896,584 A 4/1999 Hauser
5,898,938 A 5/1999 Baylor et al.
5,987,642 A 11/1999 Webster et al.
5,987,646 A 11/1999 Bolmer
6,024,712 A 2/2000 Iglesias et al.
6,059,675 A 5/2000 Finn
6,098,200 A 8/2000 Minkow et al.
6,099,936 A 8/2000 Kashihara et al.
6,260,198 B1 7/2001 LoMedico et al.
6,277,040 B1 8/2001 Randolph
6,389,596 B2 5/2002 LoMedico et al.
6,406,387 B1 6/2002 Ryan et al.
6,427,246 B1 8/2002 Doi et al.
6,557,177 B2 5/2003 Hochmuth
6,721,960 B1 4/2004 Levesque et al.
6,752,731 B1 6/2004 Kramer et al.
6,799,329 B2 10/2004 LoMedico et al.
6,932,727 B2 8/2005 Kramer et al.
6,996,849 B2 2/2006 LoMedico et al.
7,115,054 B2 10/2006 Giannetti et al.
7,179,180 B1 2/2007 Frost et al.
7,201,683 B2 * 4/2007 Estape ..... A63B 60/10 473/568
7,220,195 B1 5/2007 Cronin et al.
7,484,248 B2 2/2009 Lomedico et al.
7,572,198 B2 8/2009 Bleecker et al.
7,895,669 B2 3/2011 Kleinert et al.
8,104,098 B1 1/2012 Kleinert et al.
8,167,744 B2 5/2012 Silvain et al.
8,182,361 B2 5/2012 Gill
8,256,028 B1 9/2012 Ibon et al.
8,261,372 B2 9/2012 Drab et al.
8,490,215 B2 7/2013 Mueller et al.
8,602,925 B1 12/2013 Rickon et al.
8,813,262 B2 8/2014 Pechtold
8,839,462 B2 9/2014 Webster et al.
9,032,553 B2 5/2015 Bevier et al.
9,155,349 B2 10/2015 Madore et al.
9,155,951 B2 10/2015 Ahern et al.
9,248,355 B2 2/2016 Chauvin et al.
9,457,248 B2 * 10/2016 Long ..... A63B 71/141
2001/0053421 A1 12/2001 Schaller et al.
2002/0116743 A1 8/2002 Tourbier et al.
2003/0013563 A1 1/2003 Ryan et al.
2003/0070209 A1 4/2003 Falone et al.
2003/0144089 A1 7/2003 Ryan et al.
2004/0048696 A1 3/2004 Ciesar et al.
2004/0123373 A1 7/2004 Yamada et al.
2004/0224804 A1 11/2004 Estape et al.
2005/0002995 A1 1/2005 Schaller et al.
2005/0229286 A1 10/2005 Tseng et al.
2005/0272537 A1 12/2005 Kramer et al.
2006/0026738 A1 2/2006 Kleinert et al.
2006/0068138 A1 3/2006 Janssen et al.
2007/0028356 A1 2/2007 Cabauy et al.
2007/0261149 A1 11/2007 Gait
2008/0034466 A1 2/2008 Zicarelli et al.
2008/0085792 A1 4/2008 Sims et al.
2008/0220914 A1 9/2008 Shaw et al.
2009/0025120 A1 1/2009 Vestling et al.
2009/0038051 A1 2/2009 Fujihana et al.
2009/0042660 A1 2/2009 Shaw et al.
2009/0312125 A1 12/2009 Kearns et al.
2011/0047670 A1 3/2011 Anderson et al.
2011/0265239 A1 11/2011 Kanemitsu et al.
2012/0005805 A1 1/2012 Bevier et al.
2012/0135826 A1 5/2012 Carlson et al.
2012/0324623 A1 12/2012 Cabauy et al.
2013/0007937 A1 1/2013 Stone et al.
2013/0014307 A1 1/2013 Lee et al.
2013/0036528 A1 2/2013 Wilson et al.
2013/0067635 A1 3/2013 Lin et al.
2013/0196769 A1 8/2013 Shocklee et al.
2013/0196796 A1 8/2013 Johnson et al.
2013/0333093 A1 12/2013 Storelli et al.
2014/0215685 A1 8/2014 Bush et al.
2014/0274491 A1 9/2014 Long et al.
2014/0274497 A1 9/2014 Long et al.
2015/0164157 A1 6/2015 Garneau
2015/0272242 A1 10/2015 Bevier et al.
2015/0305415 A1 10/2015 Stone et al.
2015/0305416 A1 10/2015 Chorne et al.
2015/0367210 A1 12/2015 Long
2017/0014697 A1 1/2017 Long et al.
2017/0106262 A1 4/2017 Long et al.
2017/0172231 A1 6/2017 Long et al.

OTHER PUBLICATIONS

USPTO, International Search Report and Written Opinion for PCT/US16/65538, 7 pgs, dated Feb. 21, 2017.

Sorbathane, "The Difference Between Elastic Materials and Viscoelastic Materials," http://www.sorbothane.com/the-difference-between-

(56) References Cited

OTHER PUBLICATIONS elastic-materials-and-viscoelastic-materials.aspx, 3 pgs, Aug. 31, 2016.
Teachengineering, Integrated Teaching and Learning Program, College of Engineering, University of Colorado Boulder, "Lesson: Viscoelasticity," https://www.teachengineering.org/lessons/view/cub_surg_lesson04, 8 pgs, 2011.
Evoshield, "Baseball Catcher's Thumb Guard", http://www.evoshield.com/shop/on-field-gear/protective-gear/wrist-hand-protection/evoshield-baseball-catcher-s-thumb-guard, publication date unknown, viewed Aug. 31, 2016.
Evoshield, "Prostyle Protective Batting Gloves", http://www.evoshield.com/shop/on-field-gear/protective-gear/wrist-hand-protection/evoshield-prostyle-protective-batting-gloves, publication date unknown, viewed Aug. 31, 2016.
SIPO, "The First Office Action (with search report)", for CN201480014841.6, 21 pgs, with English translation, dated Jul. 29, 2016.
SIPO, "The First Office Action (with search report)", for CN201480014867.0, 17 pgs, with English translation, dated Jul. 26, 2016.
USPTO, "Final Office Action" for U.S. Appl. No. 13/958,309, dated Feb. 3, 2016, 4 pgs.
USPTO, "Final Office Action" for U.S. Appl. No. 13/795,916, dated May 11, 2015, 5 pgs.
USPTO, "International Search Report and Written Opinion" for PCT/US2015/037485, dated Sep. 16, 2015, 7 pgs.
USPTO, "International Search Report and Written Opinion" for PCT/US2014/022802, dated Jul. 1, 2014, 8 pgs.
USPTO, "International Search Report and Written Opinion" for PCT/US2014/022794, dated Jul. 1, 2014, 8 pgs.
USPTO, "Non-Final Office Action" for U.S. Appl. No. 13/958,309, dated Jul. 13, 2016 5 pgs.
USPTO, "Non-Final Office Action" for U.S. Appl. No. 13/795,916, dated Sep. 29, 2015, 4 pgs.
USPTO, "Non-Final Office Action" for U.S. Appl. No. 13/795,916, dated Jan. 23, 2015, 6 pgs.
USPTO, "Non-Final Office Action" for U.S. Appl. No. 13/958,309, dated Jul. 27, 2015, 6 pgs.
Intellectual Property Office, PRC China, "First Office Action", for Chinese Patent Application No. 201580033460.7 with English translation, dated Aug. 13, 2018.

* cited by examiner

REMOVABLE, ROTATABLE GRIP ELEMENT FOR A BALL BAT OR OTHER SPORTING-GOOD IMPLEMENT

CROSS REFERENCE TO RELATED APPLICATIONS

This application is a continuation of U.S. patent application Ser. No. 14/313,186, filed Jun. 24, 2014 and now pending, which is incorporated herein by reference in its entirety.

BACKGROUND

Baseball and softball batters often experience fatigue in their forearms after swinging a bat several times over a short interval. A force analysis indicates that this fatigue at least partially results from the bottom hand and the top hand opposing each other during the swing. In general, the bottom hand generally performs a pulling motion while the top hand generally performs a pushing motion. During the initial stages of the swing, as the bottom hand pulls and the top hand pushes, the barrel of the bat begins to descend into the plane of the pitched (or stationary) ball. During this time, the hands ideally rotate into the proper "power position," in which the palm of the lower hand generally faces downward while the palm of the upper hand generally faces upward. There may be some variance due to differing pitch locations but, regardless, in the power position the two palms should generally face opposite directions while being essentially coplanar. To accomplish this hand-positioning, most batters need to rotate one or both of their hands during the swing.

U.S. patent application Ser. No. 13/795,916, filed Mar. 12, 2013, and U.S. patent application Ser. No. 13/958,309, filed Aug. 2, 2013, which are incorporated herein by reference, describe various ball bats in which a portion of the bat's handle is rotatable relative to the rest of the bat to facilitate positioning the batter's hands in the power position. These bat designs, however, cannot be used in Major League Baseball, or in other leagues that require the use of a one-piece, wooden bat.

SUMMARY

A sleeve or grip for use on a ball bat or other sporting-good implement includes a low-friction inner surface and a longitudinal slit that facilitates its positioning on, and removal from, a handle of the implement. The grip is rotatable about the handle so that a user's hand may move into an optimal position during a swing. The grip may be readily removable from the implement so that, after a swing, it stays with the user, as opposed to remaining on the implement. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the several views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

While the concepts described herein may be utilized in a variety of sporting-good implements, a wooden ball bat will primarily be described. It is to be understood, however, that these concepts may also be applied to non-wooden bats, as well as to lacrosse sticks or other sporting goods where hand rotation may be desirable.

Figure 1:
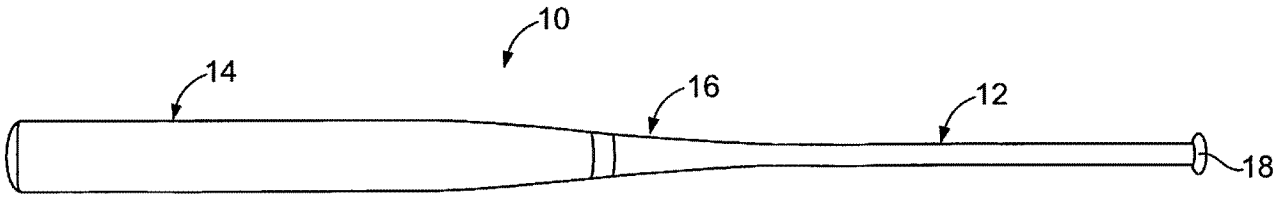
FIG. 1 is a perspective view of a ball bat, according to one embodiment.
Figure 2:
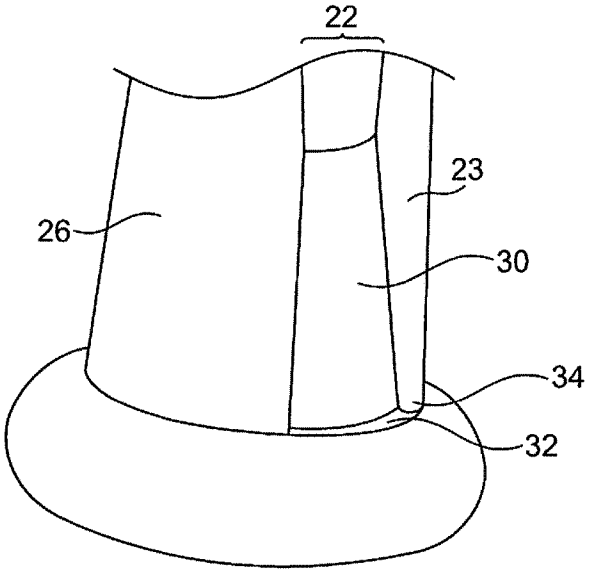
FIG. 2 is a perspective view of a bat handle including a rotatable grip element, according to one embodiment.

Turning now in detail to the drawings, as shown in FIG. 1, a baseball bat 10 includes a handle 12, a barrel 14, and a tapered section 16 joining the handle 12 to the barrel 14. The free end of the handle 12 includes a knob 18 or similar structure.

The ball bat 10 may have any suitable dimensions. For example, the ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the relevant governing association or by the user of the bat 10, and may vary between users.

As shown in FIGS. 2-5, a sleeve or grip element, or "grip" 20, includes a longitudinal slit 22 or other opening that facilitates its positioning onto the bat handle 12. The slit 22 optionally extends the entire length of the grip 20 so that the grip 20 may be opened and placed onto the bat handle 12 without having to stretch or expand the grip material around the knob 18. The grip 20 may be configured such that, once positioned on the bat 10, the edges 23 of the grip 20 defining the slit 22 return to a position near each other so that there is little or no gap between them.

In another embodiment, one or more hinged sections or gates may be included on the grip 20 at one or more of the edge regions defining the slit 22. Such a gate may be opened (via a living hinge or other hinged arrangement) to allow the grip 20 to be positioned on or removed from the bat 10, and closed over the gap created by the slit 22. In this embodiment, when a hitter finishes a swing, the hinged gate may be configured to swing open from the force of the swing so that the grip stays with the hitter.

The grip 20 may be made of a polymeric material, a thermoplastic material, a thermoset material (for example, a thermoset composite material), or another suitable material. It may be formed via injection molding, three-dimensional printing, or another suitable method.

The inner surface 24 of the grip 20 may include a low-friction material, or may be coated with such a material, so that the grip 20 may readily rotate about the bat handle 12. For example, the inner surface 24 of the grip 20 may be covered or coated with a layer of Teflon®, or with another suitable low-friction material, to facilitate rotation of the grip 20 about the handle 12. The outer surface 26 of the grip 20, conversely, may include a higher-friction material, or may be coated with such a material, so that the grip 20 is unlikely to slip out of a user's hand during swinging of the bat 10.

The grip 20 may be configured to accommodate a single hand of a user, or a portion of a hand of a user, so that only one hand of the user rotates during a swing. The grip 20, for example, may have a length of up to approximately seven inches. The grip 20 may be positioned to accommodate the user's lower hand or upper hand on the ball bat 10. If the grip 20 is positioned to accommodate the user's upper hand, a notch or groove in the ball bat 10 into which a portion of the grip 20 may be inserted or seated, or a raised projection against which the grip 20 may abut, may be included to prevent or substantially inhibit axial movement of the grip 20 during a swing. In one embodiment, multiple grips may be employed to facilitate separate rotation of both hands of a user.

In one embodiment, the bat handle's diameter increases toward the knob 18 so that the grip 20 may be positioned over the upper-handle region, then slid down toward the knob 18 to engage in a frictional fit with the larger-diameter region 30. The knob 18 prevents the grip 20 from slipping off of the end of the bat 10. If the grip 20 is positioned against the knob 18, its lower surface may include a low-friction material so that the grip 20 may rotate against the knob 18.

The knob 18 may include a circular channel or groove 32 into which a projecting portion 34 of the grip 20 may seat to aid in properly positioning the grip 20. Other configurations or features, such as a tongue-and-groove configuration, a hinged configuration, or inclusion of a magnetic pin or similar device to inhibit axial movement of the grip 20, may additionally or alternatively be used to properly position the grip 20.

Figure 5:
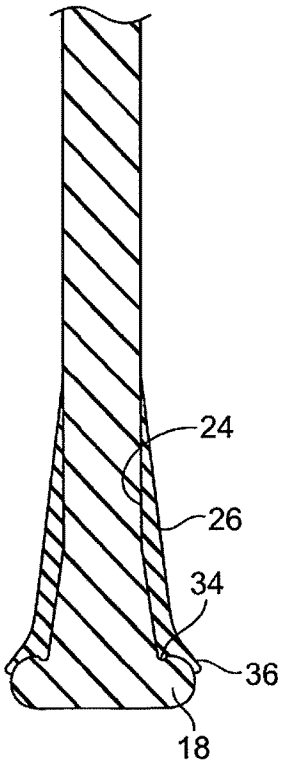
FIG. 5 is a sectional view of the bat handle of FIG. 4 taken along Section A-A.
Figure 4:
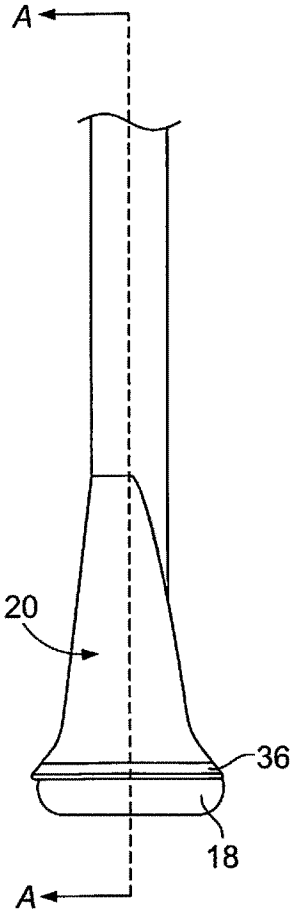
FIG. 4 is a side view of the bat handle and rotatable grip element shown in FIG. 3.
Figure 3:
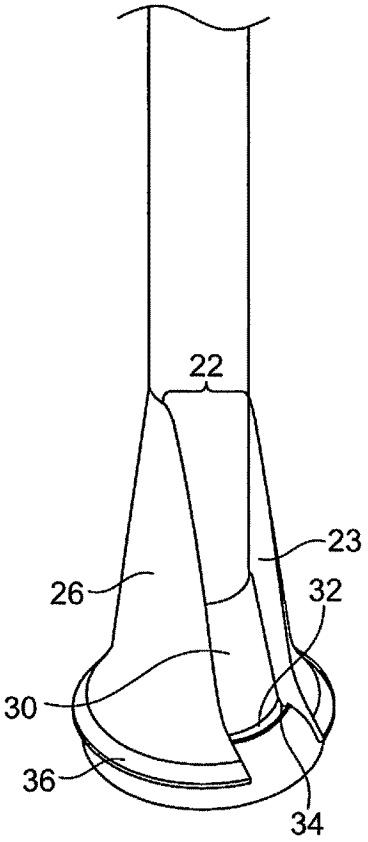
FIG. 3 is a perspective view of a bat handle including a rotatable grip element with a knob flange, according to one embodiment.

As shown in FIGS. 3-5, the grip 20 optionally includes a flange 36 configured to cover at least a portion of the knob 18 so that a user's bottom hand does not catch on the knob 18 during a swing. In some embodiments, the circumferential groove 32 in the knob 18, and the knob flange 36 on the grip 20, may be used in conjunction with each other.

Figure 6:
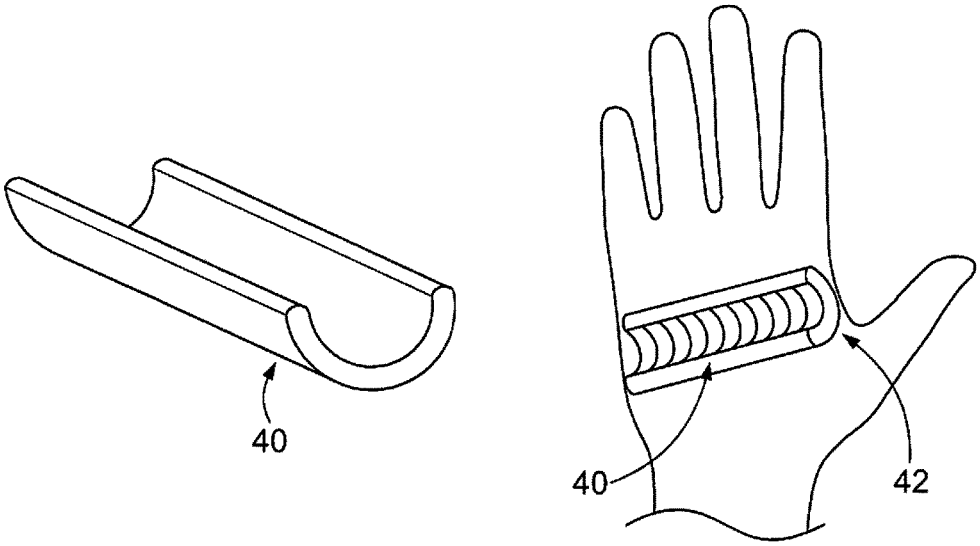
FIG. 6 is a perspective view of a batting glove attached to a low-friction grip element, according to one embodiment.

As shown in FIG. 6, in other embodiments, a partially circular or semi-circular attachment or grip 40, having a low-friction inner surface, may be attached to or positioned against a user's batting glove 42 or hand. If attached, the grip 40 may be fixed to the glove 42 via Velcro®, stitching, adhesive, or another suitable connector. The grip 40 conforms to the shape of a portion of the bat handle 12 when a user closes his or her hand around the handle 12. The low-friction inner surface of the grip 40 provides rotation of a user's hand about the handle 12 during a swing. The grip 40 may stay with the user after the swing.

Figure 7:
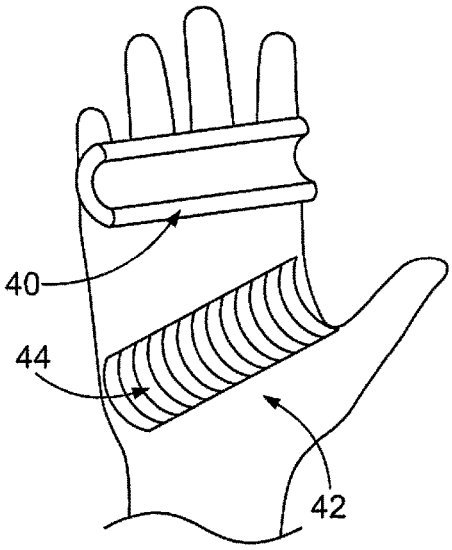
FIG. 7 is a perspective view of a batting glove including a channel and attached to a low-friction grip element, according to one embodiment.

As shown in FIG. 7, in some embodiments, the batting glove 42 may include a rounded, optionally semi-rigid, channel 44 in its palm region. The channel 44 may have a low-friction surface to facilitate rotation of the handle 12 against the channel's surface. An attachment or grip, such as the grip 40 shown in FIG. 6, may be attached to or positioned against the finger-region of the batting glove 42. When a user grips the handle 12, the channel 44 and the grip 40 provide rotational surfaces around a substantial portion of, or all of, the circumference of the handle 12.

Figure 8:
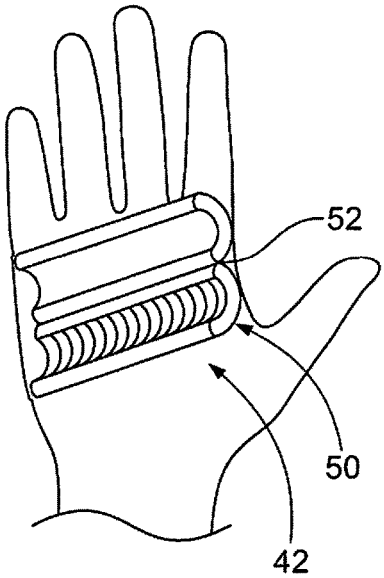
FIG. 8 is a perspective view of a batting glove attached to a hinged grip element, according to one embodiment.

As shown in FIG. 8, in some embodiments, a hinged grip 50, having a low-friction inner surface, may be attached to or positioned against a user's batting glove 42. The grip 50 includes a hinge 52 running along its length. The hinge 52 may be positioned at the base of a user's fingers or along the palm. This configuration also provides rotational surfaces around a substantial portion of, or all of, the circumference of the handle 12.

The embodiments described herein provide improved relative hand rotation for baseball and softball players. These features are particularly applicable to professional baseball or other leagues that have rules similar to those of Major League Baseball (e.g., that a one-piece wooden bat must be used). Because the rotatable grips described herein are not part of the bat itself, they provide relative hand rotation to the user without adding a permanent fixture to the bat. Indeed, the grips described herein may optionally be removed from the bat during a swing. As used herein, the term "during" is also intended to cover situations in which a hitter removes a grip from the bat immediately or shortly after completing a swing.

Any of the above-described embodiments may be used alone or in combination with one another. Furthermore, the ball bats or grips may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A grip element for use on a sporting-good implement having a knob, the grip element comprising:

a body having a length, a first end, and a second end;

a substantially linear opening along the length of the body;

a low-friction inner surface; and a projection located substantially at the first end, the projection being configured to mate with a groove in the knob;

wherein a portion of the grip element is positioned to rotate against a portion of the knob; and wherein the body is tapered between the first end and the second end.

2. The grip element of claim 1 wherein the length of the body is seven inches or less.

3. The grip element of claim 1, further comprising a flange configured to fit over at least a portion of the knob.

4. The grip element of claim 1, further comprising a hinge along the length of the body opposite the opening.

5. The grip element of claim 1 wherein the linear opening facilitates removal of the grip element from a sporting-good implement during a swing.

* * * * *